US008904936B2

(12) United States Patent
Treadway et al.

(10) Patent No.: US 8,904,936 B2
(45) Date of Patent: Dec. 9, 2014

(54) GRADED PROPERTY BARRIERS FOR ATTENUATION OF SHOCK

(75) Inventors: Sean Kevin Treadway, Mooresville, NC (US); John R. Cogar, Mooresville, NC (US); Andrew Nicholas Lloyd, Mooresville, NC (US)

(73) Assignee: Corvid Technologies, Mooresville, NC (US)

( * ) Notice: Subject to any disclaimer, the term of this patent is extended or adjusted under 35 U.S.C. 154(b) by 676 days.

(21) Appl. No.: 13/215,715

(22) Filed: Aug. 23, 2011

(65) Prior Publication Data

US 2012/0174811 A1 Jul. 12, 2012

Related U.S. Application Data

(60) Provisional application No. 61/376,870, filed on Aug. 25, 2010.

(51) Int. Cl.
*F42B 3/02* (2006.01)
*F42D 5/045* (2006.01)

(52) U.S. Cl.
CPC .. *F42D 5/045* (2013.01); *F42B 3/02* (2013.01)
USPC ..... 102/315

(58) Field of Classification Search
CPC ..... F42B 3/02
USPC ..... 102/315, 478, 475, 492, 495, 316, 317, 102/320
See application file for complete search history.

(56) References Cited

U.S. PATENT DOCUMENTS 7,066,093 B2 * 6/2006 Ronn et al. ..... 102/489
2014/0113086 A1 * 4/2014 Greenhill et al. ..... 428/34.1

* cited by examiner

*Primary Examiner* — Reginald Tillman, Jr.
(74) *Attorney, Agent, or Firm* — Oblon, Spivak, McClelland, Maier & Neustadt, L.L.P.

(57) ABSTRACT

A barrier for reduction of a shock wave. The barrier has a spatially graded structure in which a density of the structure varies across a thickness thereof. The graded structure includes a polymer having hollow containers dispersed in the polymer to provide the density of the graded structure. The barrier can be included in at least one of 1) an explosive device, 2) a war head, 3) a demolition charge, and 4) an explosive containment. These devices have an exterior housing and at least one partitioned segment inside the housing with the partitioned segment including the barrier for reduction of the shock wave. Partitioned sections of the explosive devices are selectively or in total detonated.

55 Claims, 12 Drawing Sheets

Research sample micrograph of microballons in resin matrix

Barrier material graded outward from ordnance

GRADED PROPERTY BARRIERS FOR ATTENUATION OF SHOCK

CROSS REFERENCE TO RELATED APPLICATIONS

This application is related to and claims priority under 35 U.S.C. 119(e) to U.S. Application Ser. No. 61/376,870, filed Aug. 25, 2010, entitled "GRADED PROPERTY BARRIERS FOR ATTENUATION OF SHOCK," the entire contents of which are incorporated herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract Nos. FA8651-07-M-0201 and FA8651-08-C-0167 awarded by the Air Force.

BACKGROUND OF THE INVENTION

1. Field of the Invention

The invention generally relates to mitigating transmission of shock waves. Specifically, in various forms, the invention can be used to limit the transmission of strong shock waves produced by detonations to limit damage and/or reaction of nearby material.

2. Discussion of the Background

Variable yield munitions have been used for conventional high explosives (HE) in a general purpose bomb framework. Typical munitions produce a single level of yield, which consists of various effects. These effects may include explosive blast, brisance to structural, and projection of containment fragments and/or preformed projectiles. The yield for a munition is typically fixed based on their design and generally cannot be changed after manufacture. Traditionally, numerous sizes and types of munitions have been required to address the large range of possible battlefield scenarios. This requires extensive manufacturing capacity, large inventories, and complex logistics to wage military campaigns.

The pace and precision of military operations is, to a large extent, dictated by the munitions at the disposal of commanders. Adapting to changing situations is often not possible because munition yields and effects are fixed at the outset of missions. This inability to adapt to changing situations often results in missed opportunities for mission success, or unintended outcomes due to excessive and imprecise munition yield.

SUMMARY OF THE INVENTION

In one embodiment, there is provided a barrier for reduction of a shock wave. The barrier has a spatially graded structure in which a density of the structure varies across a thickness thereof. The graded structure includes a polymer having hollow containers dispersed in the polymer to provide the density of the graded structure.

In one embodiment, there is provided an explosive device having an exterior housing and partitioned segments inside the housing. At least one of the partitioned segments is filled with an explosive material. The explosive device has a partition wall separating the segments, wherein the partition wall has a barrier for reduction of a shock wave. The barrier has a spatially graded structure in which a density of the structure varies across a thickness thereof. The graded structure includes a polymer having hollow containers dispersed in the polymer to provide the density of the graded structure.

In one embodiment, there is provided a variable yield warhead on a missile or munition having an exterior housing and a bomb comprising partitioned segments inside the housing. At least one of the partitioned segments is filled with an explosive material. The war head charge has a partition wall separating the segments, wherein the partition wall has a barrier for reduction of a shock wave to prevent detonation of adjacent segments. The barrier has a spatially graded structure in which a density of the structure varies across a thickness thereof. The graded structure includes a polymer having hollow containers dispersed in the polymer to provide the density of the graded structure. In one aspect of this embodiment, the warhead can be a variable yield warhead where one or more of the segments are selectively initiated to provide for variable warhead yield.

In one embodiment, there is provided an explosive containment having an exterior housing and an explosive compartment comprising 1) at least one partition wall inside the housing and 2) at least one segment configured to hold an explosive material. The partition wall has a spatially graded structure in which a density of the structure varies across a thickness thereof. The graded structure includes a polymer having hollow containers dispersed in the polymer to provide the density of the graded structure.

In one embodiment, there is provided a system for making a graded barrier. The system includes a polymer resin applicator which supplies an uncured polymer to a workpiece, a distributor which distributes at least one of hollow containers and solid particles into the uncured polymer as the uncured polymer is being supplied to the workpiece, and a curing unit to cure the workpiece. The distributor is configured to provide at least one of hollow containers and solid particles into the uncured polymer at a varying rate which produces a spatially graded structure in which a density of the structures varies across a thickness of the workpiece.

In one embodiment, there is provided a polymer composite comprising a polymer having hollow containers dispersed in the polymer and fibers dispersed in the polymer to increase the strength of the composite.

In one embodiment, there is provided a method for making a graded barrier. The method includes supplying an uncured polymer to a workpiece, distributing at least one of hollow containers and solid particles into the uncured polymer as the uncured polymer is being supplied to the workpiece, and curing the workpiece. In the method, the hollow containers or the solid particles are provided into the uncured polymer at a varying rate which produces a spatially graded structure in which a density of the structures varies across a thickness of the workpiece.

It is to be understood that both the foregoing general description of the invention and the following detailed description are exemplary, but are not restrictive of the invention.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
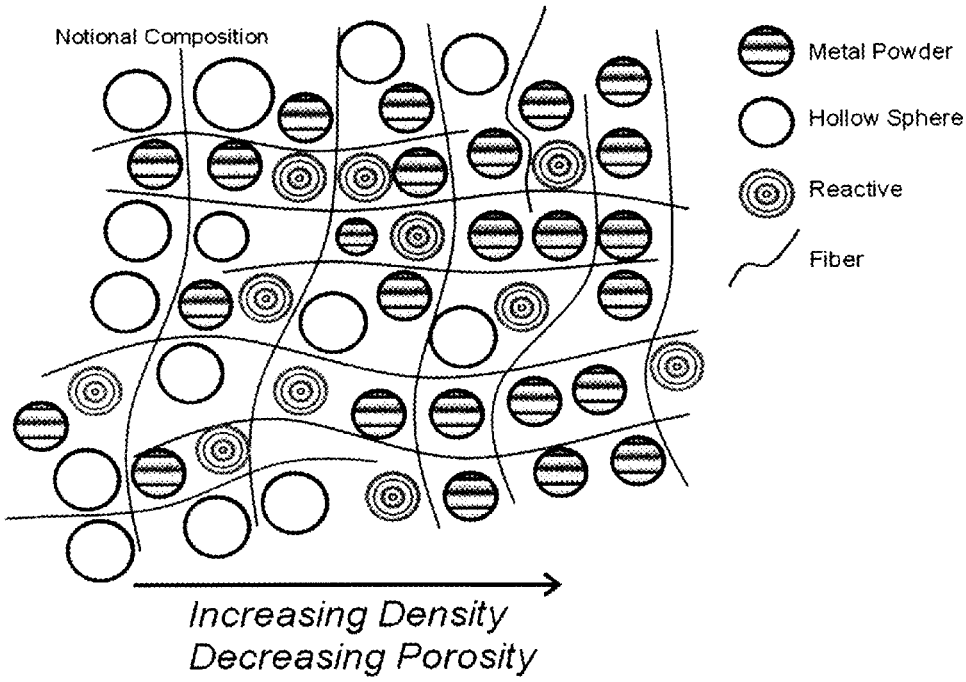
FIG. 1 shows a schematic of graded barrier composition, according to the invention.

This invention addresses deficiencies of prior art by providing a higher degree of shock attenuation, and a reduction of transmitted shock to contacting materials. The graded property barriers of the invention provide variable yield and variable effect munitions, which increase the flexibility and precision available to warfighters.

In one embodiment of this invention, graded property barriers provide mass and volume efficient attenuation of a detonation shock produced by explosives. The graded property barriers permit the design and cost effective production of explosive systems having selectable yield and effect by reliably preventing shock-to-detonation in explosive components. The graded property barriers provide a light weight protection from explosive devices and for explosive devices.

In an explosive device, a shock wave (i.e., a discontinuity in density, pressure, and temperature which advances through a material with a velocity corresponding to the maximum pressure the pulse) propagates from the explosion. Shock waves are characterized by a wave moving at a velocity higher than the sound speed in a given material. This is not to be confused with abrupt loading or impact that is often referred to as shock. The graded property barriers of the invention therefore attenuate shock waves in solids, as opposed to shock waves in a gas, which are commonly referred to as blast waves.

Further, the invention in one embodiment is improved by its ability to carry structural loads, which is effective at densities on par with conventional plastics. These advantages for the graded property barriers of the invention permit devices, systems, methods, and others products to mitigate the effect of propagating shock waves, e.g., strong shock waves in solid materials (>1.0 GPa, rise time<10 microseconds). In one embodiment of the invention, compact assemblies separated by the graded property barriers of the invention will have a substantial reduction in weight and volume as compared to conventional storage and munitions high explosive handling devices. Such devices utilizing the graded property barriers of the invention include for example bombs and warheads, demolition charges, fuel storage vessels, and both permanent and portable protection of munitions and reactive materials.

The graded property barriers of the invention (in one embodiment) include a polymer matrix filled with varying amounts of metal particles and hollow spheres. The amount and type of metal particles and hollow spheres dictate the barrier density and acoustic impedance properties.

In this respect, the graded property barriers of the invention resemble syntactic foams which were formed by filling a metal, polymer or ceramic matrix with hollow particles called microballoons. However, in the syntactic foams, graded densities were not needed as the primary use of the syntactic foams was in buoyancy aid materials for marine applications and in sporting goods such as soccer balls and in radar and sonar transparent coverings. The presence of hollow particles in the syntactic foams resulted in lower density, higher strength, a lower coefficient of thermal expansion. A wide variety of microballoons were used for syntactic foams and can be used in the invention, including cenospheres, glass microspheres, and carbon and polymer microballoons. To the inventors' knowledge, syntactic materials have not been used to date with graded densities and have not been designed for attenuation of strong shockwaves created by hypervelocity impact or impinging detonation waves. Furthermore, the inventors have realized that the addition of fibers, to what might otherwise be considered a conventional syntactic foam, in on embodiment of the invention creates a relatively high strength material for shock blast moderation or other applications.

In the invention, the ability to control the density and mixture of materials in the graded barrier layer permit barrier attenuation performance to be maximized based on intended shock loads. In one embodiment, the barrier is solid in form with a density that varies between 0.5 and 2.0 gram/cm$^3$, depending on fill quantities and types. In one embodiment, the graded property barrier acts a barrier for shock through two mechanisms:

1) Strong shock acting upon the invention is dissipated thorough shock heating, viscous effects, and scattering as it transverses the barrier, 2) The barrier maintains low acoustic impedance at its boundaries, resulting is minimal shock transmission to shielded materials.

Specifically, in one embodiment, the graded structure is configured to attenuate pressures shock waves of magnitudes>0.1 GPa. In other embodiments, pressures between 10 to 25 Gpa would be attenuated by an order of magnitude. Lower pressure generating explosives will need less attenuation to prevent inadvertent detonation. More shock sensitive explosives will need more attenuation. Conversely, explosives with higher shock tolerance (insensitive) will need less attenuation.

In one embodiment, the graded property barrier includes metal particles such as for example aluminum, iron, magnesium, lithium, zinc, or any other metals that will not chemically react at typical storage and operational environmental conditions and pressures for high explosive. Typical conditions include temperatures ranging from −30° C. to +100° C., and nominal atmospheric pressures. These reductive metals, which under nominal conditions are non-reactive, may become reactive during the conditions created by explosive detonation, heating, and exposure/mixing with/to oxidizers other materials. These oxidizers material may be include oxygen, fluorine, water, percolates, and various electronegative substances, that may be present in the operational environment or dispersed in the barrier material. Inclusion of such metals and oxidizers in either a solid or dispersed form (in one embodiment of the invention) is designed for deflagration during the explosion, providing a mechanism for the burning of unspent explosive material, and providing additional energy release, but at a lower rate than the high explosive.

In one embodiment, the metal particle sizes are less than 1 mm. In one embodiment, the metal particle sizes range down to nano-particle scale. Ideal particle size is on par with the shock gas kinetic mean free path length of a specific barrier composition, and is a function of shock loading. Macroscopic viscous dissipation is cause by motion of metal particles, and interaction with other components, during shock induced flow at, and behind, the shock front.

In one embodiment, the graded property barrier includes hollow structures such as for example hollow spheres. The hollow spheres or other hollow structures can be made of a glass, a ceramic, or a carbon. In one embodiment, the sphere size or structure size ranges from 10 to 200 μm; (typically referred to as microspheres or microballons or microstructures).

In one embodiment, the graded property barrier has a barrier porosity ranging from 10% to 50%, 15% to 30%, and more particularly 18% to 25%. In one embodiment, the barrier porosity exists in a hollow region of the sphere or microstructure interiors. Hollow microspheres or microstructures are poor transmitters of shock and acoustic energy. The hollow microspheres or microstructures create dissipative shock scatter up until the point of the collapse of the sphere. Dissipative heating is created upon collapse of the spheres or microstructures due to the thermodynamic work (i.e., P dV where P is the nominal pressure and dV is the void space inside the sphere being reduced to zero). Collapse of microstructures also creates a multitude of rarefaction waves that propagate into the shock front and attenuate the shock front. Collapse pressure is dependent on sphere wall thickness and material. Hollow spheres or microstructures allow low densities to be achieved while maintaining structural strength.

In one embodiment, the graded property barrier includes a polymer. The polymer may be any liquid or powder resin where particles can be mixed or dispersed into, and then cure to a solid so that the position of the hollow microspheres or microstructures or metal particles therein is fixed in the solidified polymer resin matrix. Possible resins include epoxy, urethanes, polyureas, polyamides, and other curable resins. In one embodiment, the polymer materials do not chemically react in a detrimental manner with the metal or sphere or microstructure components during resin curing, and after that do not react at nominal temperatures and pressures. As described above, the metals may become reactive during the conditions created by explosive detonation and heating, and may be designed to deflagrate in either a solid or dispersed form.

In one embodiment, the graded property barrier includes carbon, glass, or aramid fibers, added to enhance strength. In one embodiment, the fiber length would be on the order of a millimeter. Fibers of longer lengths (e.g., a cm) and of shorter lengths (e.g. a micrometer or less) could be used. In one embodiment, the graded property barrier includes fiber composite textiles and roving, added to provide rigidity and strength for structural load carrying capacity, thereby acting in a dual-role capacity in an assembly. Examples include the use of the material as the skin or aeroshell of a UAV or missile, or packaging for lightweight selectable-yield hand grenades.

In other embodiments, the graded barrier has a barrier density ratio from donor side to acceptor side of at least 2 to 1. The barrier density may change in a stepwise manner through thickness from the donor side to the acceptor side (See FIG. 3). The barrier density may change in a continuous manner through thickness from the donor side to the acceptor side. When microballoons and fiber are used, the barrier density can change linearly from donor side to acceptor side. When metal particles are included in the composition, the barrier density can change exponentially.

In other embodiments, the microballoons have a collapse strength of 250 to 28000 psi. Barrier collapse strength at any point through the thickness is inversely proportional to microballoon content percentage by volume. In one embodiment, the microballoon content can be as high as eighty percent by volume, with porosity being dependent on the wall thickness of the microballoon.

The invention achieves particular advantages over prior art due to its spatially graded properties. The invention is effective in strong shock dissipation due to heterogeneous composition and specific distributions of the various components described above. The inventors have realized and implemented a graded barrier where the shock attenuating effect afforded by an oriented density/impedance gradient in the barrier composition. The inventors have achieved this effect by design in a consistent and predictable manner using lightweight materials.

Calculations by the inventors of porous barrier responses produced a surprising result heretofore to the inventors' knowledge not known. When loaded by HE detonation waves, the lower density/higher porosity barrier materials that produced the strongest shock attenuations also tended to produce detonations more readily, relative to the higher density/lower porosity materials. This is somewhat counterintuitive since one might expect barriers that create greater reductions in shock pressure to more readily prevent detonation of shielded explosive. However, simulations by the inventors have shown that barriers with >50% initial porosity are fully collapsed to near ideal density just behind (<1 mm) the detonation induced shock front. Barriers with <25% initial porosity are fully collapsed much farther behind the shock front (>3 mm). The fully collapsed barrier material has higher acoustic impedance and therefore a higher shock transmission efficiency. The result is that barriers with >50% initial porosity transmit more shock energy to the acceptor explosive, which results in a detonation.

FIG. 1 shows a schematic of graded barrier composition. Moving from left to right in the schematic of FIG. 1 across the graded barrier, the porosity decreases due to fewer and fewer hollow spheres. An increasing density gradient is created by allowing resin and/or fiber to fill in for the hollow spheres. Density can be further increased left to right by filling in with solid particles. These solid particles may be metals or energetic materials which react during detonation to further burn unspent explosive material and in rapidly deflagrate provide lower rate energy release that is desirable in precision effect munitions.

An example of a barrier which has been produced according to one embodiment of the invention is a barrier including Pro-Set™ 125/237 epoxy resin, 3M™ high-strength microballoons (See Table below), and 30 micron pyrotechnic aluminum powder. All barrier materials created today have used 4 different kinds of 3M soda-lime-borosilicate glass microballoons, specifics are listed in Table 1 below. The sample thickness was approximately 1 cm, and a density variation across the thickness of the barrier was from 2 g/cc to 0.5 g/cc. The higher density side includes primarily an aluminum fill, and the low density side included primarily the microballoons. The density gradient was approximately a linear gradient.

TABLE 1

| Type | Static Crush Strength (psi) | True Density (g/cc) | Thermal Conductivity (W/(m*K)) |
|---|---|---|---|
| K1 | 250 | 0.125 | 0.047 |
| K46 | 6000 | 0.46 | 0.153 |
| S60 | 18000 | 0.6 | 0.2 |
| iM30K | 28000 | 0.6 | 0.2 |

An example of a barrier which has been produced according to one embodiment of the invention is a barrier including Pro-Set™ 125/229 epoxy resin and 3M™ high-strength microballoons of more than one type. The sample thickness was approximately 1 cm, and a density variation across the thickness of the barrier was from 0.5 g/cc to 1.1 g/cc. Density gradient (and balloon distribution variation) was approximately linear from donor side to acceptor side.

The shock wave attenuating characteristics of the graded barrier make it possible to manage detonation waves with reduced energy transfer to the surrounding environment. This enables the creation and enhancement of shaped charges that deliver more effective and focused shock loads. Effectiveness of the barrier has been found to depend on its orientation to the impinging shockwave. Regardless, in one embodiment of the invention, the barrier is oriented such that shock impinges on the more dense side and attenuation occurs as this shock traverses the barrier in the direction of decreasing density. The approach direction of the detonation wave is dependent on initiation location, which is specific to the design of any qualified or improvised munition. Hence, the initiation location is a matter of choice, and the barrier can be properly oriented for any given design. The structural configuration depicted in FIG. 1 permits the design of lighter weight demolition charges by reducing both the required high explosive mass and reaction mass. A partitioned demolition charge design would permit a closer proximity of explosive sections than conventionally used, and would allow for extended delays between initiations of charges. Also, a partitioned demolition charge design would allow design improvements in shaped charge capsules used in explosive drilling and rock fracture.

EXAMPLES

A basic implementation of the graded barrier for shielding an explosive charge and preventing sympathetic detonation is illustrated in FIG. 4. The barrier is comprised of four homogeneous layers that together form a stepwise gradation in density, porosity, strength, and shock impedance. Shock attenuation is enhanced by the impedance difference between the layers. This difference creates shock reflections at the barrier interfaces. In the experimental arrangement shown in FIG. 4, the barrier is placed between two explosive charges, referred to as the donor and the shielded charge (or "acceptor"). Both charges in this example are PBX-N109 high explosive. The density of the individual layers progresses from the donor interface to the acceptor interface as follows: 1.59 g/cc, 0.9 g/cc, 0.780 g/cc, 0.6125 g/cc. Each barrier layer is approximately 0.5 cm thick, for a total thickness of approximately 2 cm. An "equivalent" homogeneous aluminum barrier necessary to prevent acceptor detonation is approximately 6 cm. Given the overall barrier density of 0.97 g/cc in this case, and the 2.7 g/cc of aluminum, the aluminum barrier would be 8.3 times heavier. In this example, the donor charge detonation is initiated on the end opposite the barrier. This sort of "end initiation" is consistent with the vast majority of ordnance in use today. The detonation wave progresses through the donor in the direction of barrier, impinges on the barrier, and the shock load is attenuated to below the shock-to-detonation threshold of the explosive. Experiments by the inventors have shown that the barrier reduces detonation pressure and shock velocity by approximately 80%.

Figure 2:
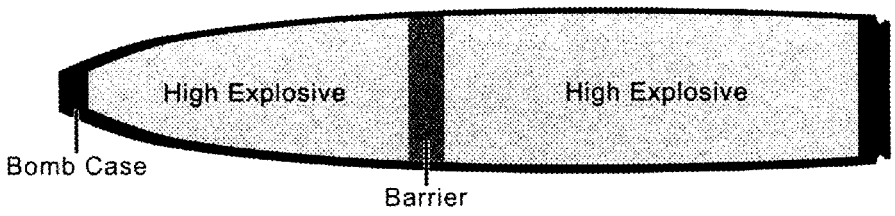
FIG. 2 is a schematic of a graded barrier of the invention in a bomb casing.
Figure 3:
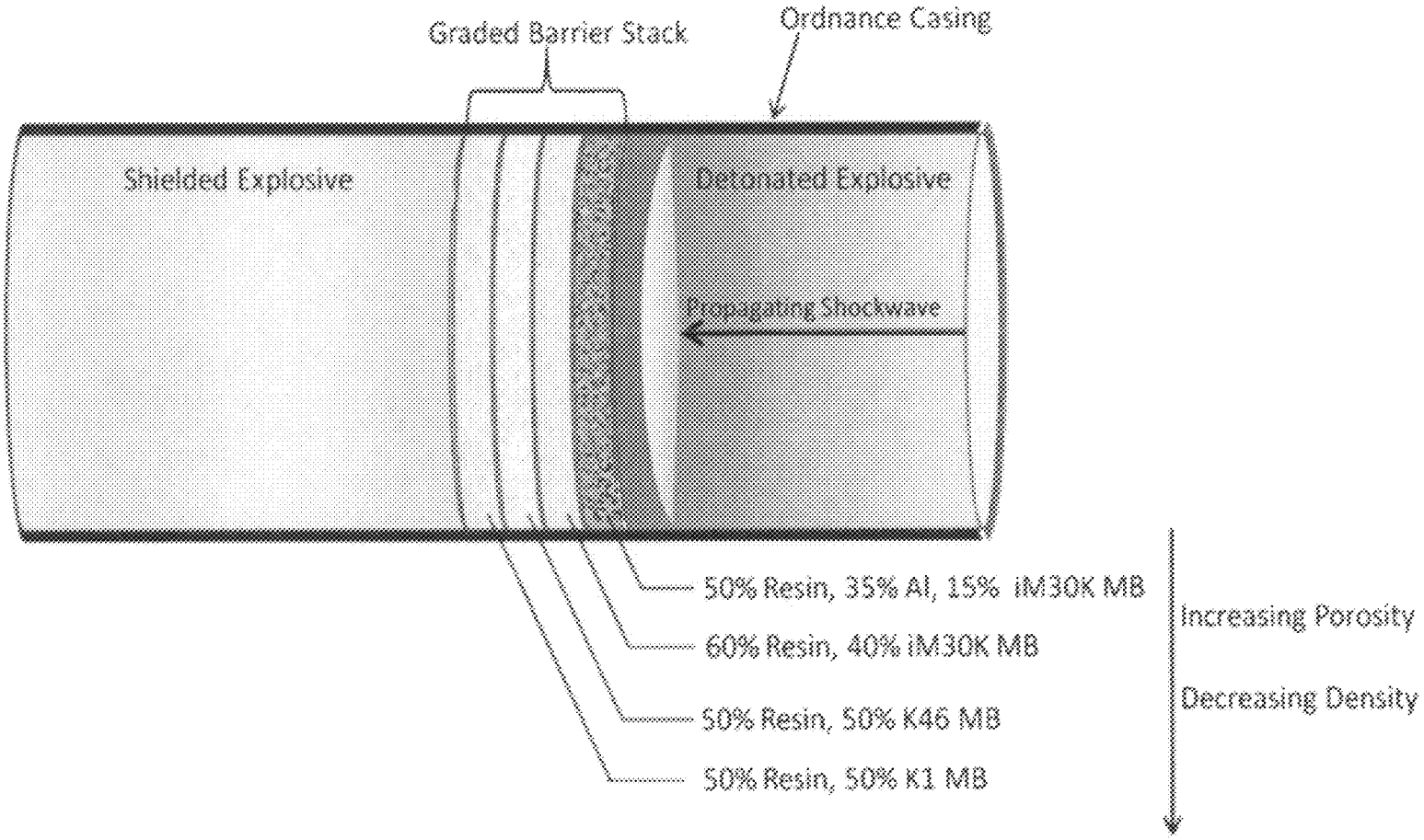
FIG. 3 is a schematic of graded barrier composition, according to the invention, in which the graded barrier includes a series of different density regions.

In one embodiment of the invention, the graded barrier exists as a partition between high explosive HE filed regions in a bomb. FIGS. 2 and 3 are schematics of a graded barrier of the invention in a bomb casing. Incorporation of the barrier would prevent sympathetic detonation of one or more HE regions when another region is intentionally detonated. The function of the barrier in this instance is to attenuate very strong (>20 GPa pressures) shock waves created by HE detonation, and to transmit pressures too low and fleeting to cause sympathetic detonation. The result would be a reliable compartmentalized variable yield munitions having maximum yields that are on par with traditional unitary munitions of the same weight. An example would be a PBX-N109 high explosive Mk82 500 lb general purpose bomb with barrier material partitioning the explosive fill in a ratio of 2 to 1. Effective barrier thickness would be approximately 12.5 cm, with a density variation of 2 g/cc to 0.8 g/cc, and composed of epoxy resin, high strength microballoons, and glass fibers approximately 2 mm in length and having a diameter on the order of 15 micron. FIG. 2 is an illustration of this scheme.

In this embodiment, the graded barrier is designed to have compaction pressures roughly an order of magnitude less than typical HE detonation pressures (1 to 2 GPa), and the highest possible shock impedance. In weapons applications, the barrier material mass and volume are typically minimized so that overall system mass and volume are not significantly increased and lethality is not diminished. Further, a fiber filled barrier would have structural strength on par with conventional structural plastics so that reinforcement is not necessary, e.g. ABS plastic, which has a typical density of 1.2 g/cc, tensile yield of 41 MPa, and elastic modulus of 2.4 GPa.

A barrier material of the invention in one embodiment will have a structural compressive strength of at least 20 MPa, and an elastic modulus between 1.2 and 4 GPa. Values of stiffness and strength will be dependent on resin component properties, microballoon volume fill fraction, fiber volume fill fraction, and solid particle volume fill fraction. For example, the following formulation would yield a stiffness and strength near the stated upper limits:

50% volume fill epoxy, Pro-Set 135/226,
30% volume fill microballoons, 3M iM30K, and
20% volume fill aluminum particle, 200 micron.

A combination with strength and stiffness properties near the low end would be:

60% volume fill polyurea, Creative Material Tech. 9086, and
40% volume fill microballoons, 3M K1.

This combination would also provide high energy absorption in a progressive manner during crush due to the high strain-to-failure (>200%) of the polyurea resin.

This invention in one embodiment incorporates energetic materials in powder form into the barrier. Dispersed energetic materials in this embodiment replace some of the energetic load (HE) displace by the barrier. In the proper amounts, energetic material would increase energy delivered to target, and aid in the deflagration of un-detonated explosive.

Figure 5:
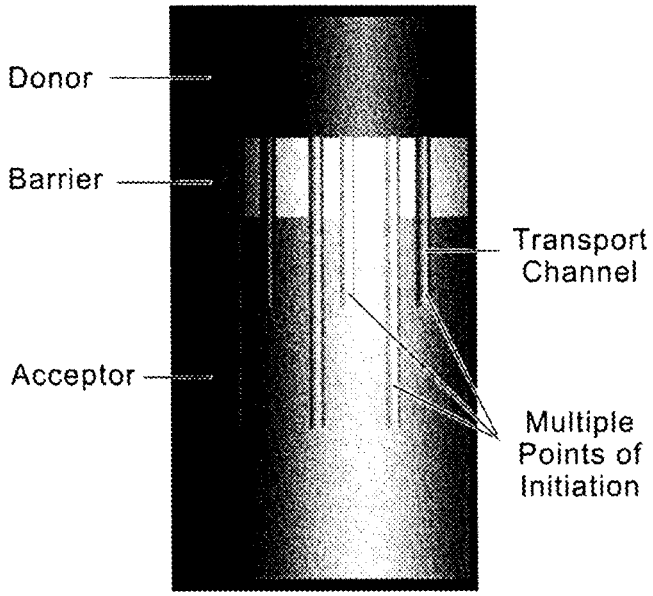
FIG. 5 is a schematic illustrating deflagration of HE regions by a channel through the barrier for porting reaction products from detonating regions.
Figure 6:
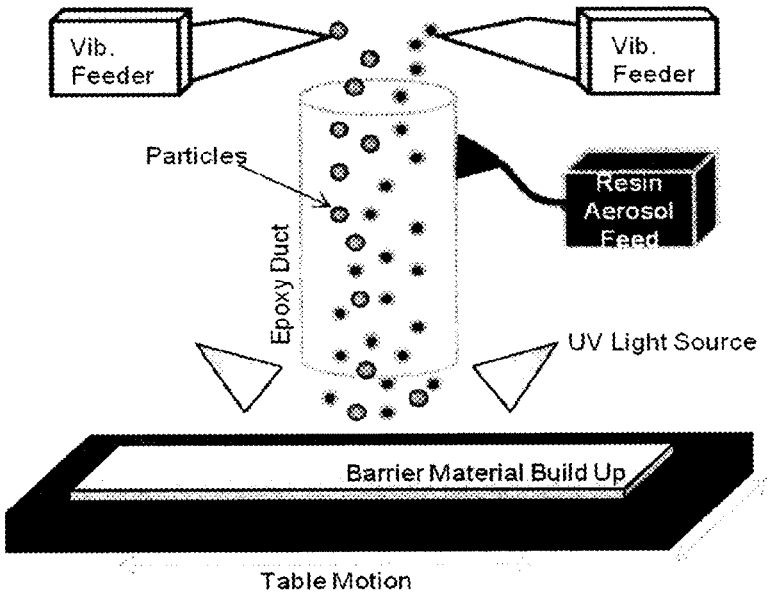
FIG. 6 is a schematic illustration of a barrier material production system.
Figure 7:
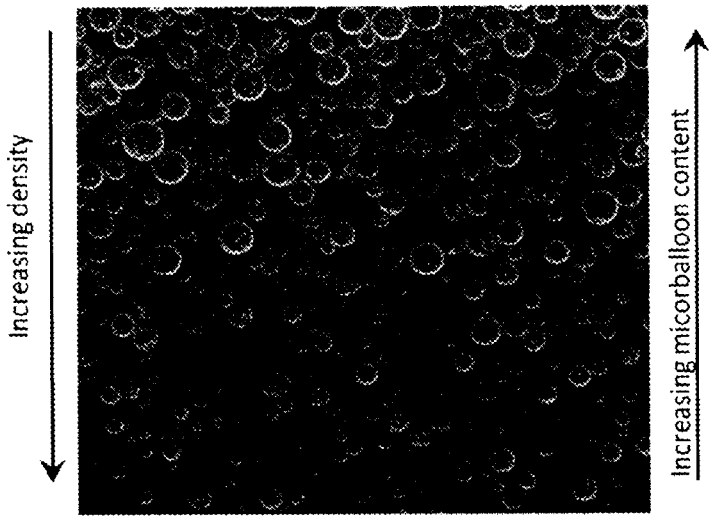
FIG. 7 is a micrograph of density graded barrier material that illustrated the distribution of microballoons through a section.
Figure 8:
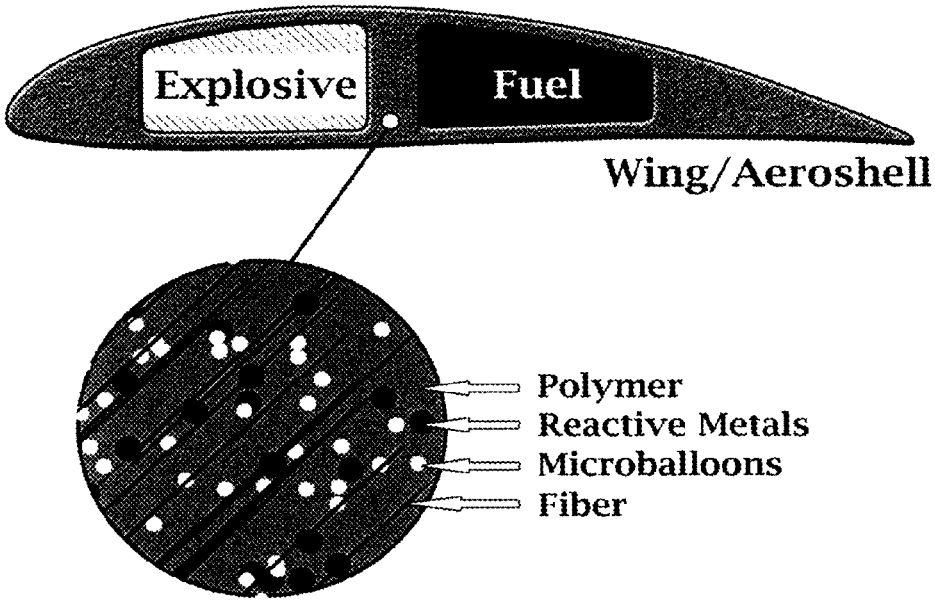
FIG. 8 is a depiction of the barrier material serving a dual role as a structural energetic in an UAV aeroshell/airframe application.
Figure 9:
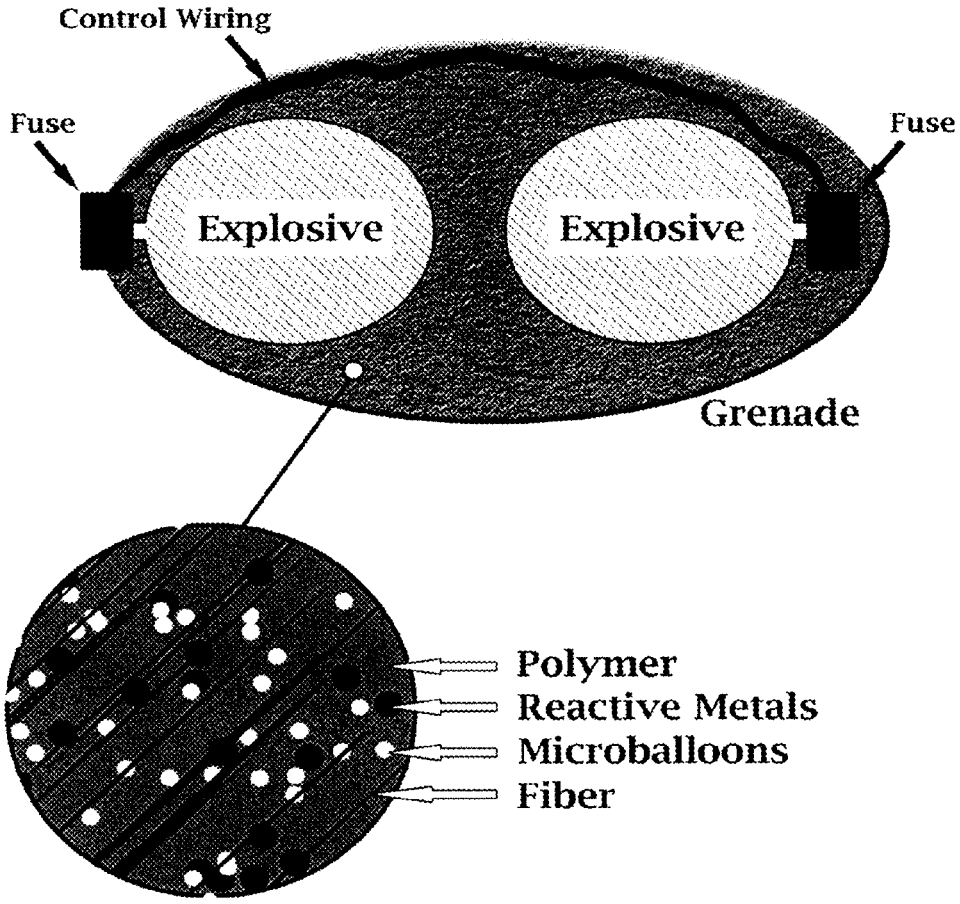
FIG. 9 is a depiction of the barrier material serving a dual role as a structural energetic in a notional variable yield hand grenade design.

This invention in one embodiment provides a desired deflagration of HE regions by providing a channel through the barrier for porting reaction products from detonating regions. FIG. 5 shows a schematic of this arrangement. This may be accomplished by one or more hollow tubes that penetrate the HE regions and pass through the barrier. These tubes allow hot, high pressure detonation reaction products to be transmitted across the barrier. The end of each tube in the shielded energetic material becomes a potential initiation site. Tubes of the proper size, material, and depth of penetration will initiate deflagration. Exact tube dimensions and depth of penetration are a function of the size of the HE regions, HE type, and bomb containment geometry.

For example application in general purpose bomb of 500 lb or greater, which typically use aluminized and relative insensitive explosive fill such as PBXN-109 or AFX-757, up to three tubes made of filament wound glass fiber could be used, evenly spaced in a triangular array. Approximate tube dimensions would be 3 cm outer diameter and 2 cm inner diameter. The tubes would extend into the acceptor fill a minimum distance equal to the diameter of the bomb case at the location of the barrier, which would be approximately 23 cm in the case of a Mk 82 GP bomb. Maximum tube extension into the acceptor fill would be approximately 5 cm less than the full length of the acceptor fill cavity. Inclusion of the tubes has only a limited effect on barrier effectiveness; therefore the barrier design is the same, save bore hole required for penetration by the tube(s).

Use of multiple tubes provides multiple initiation sites with minimal displacement of energetic material. In the case of detonation, multiple initiation sites are used to create detonation waves with a desired direction, and thereby the capability to directionally vary the velocity of bomb/warhead case fragments and blast wave intensity.

This invention in one embodiment allows for the creation of a warhead capable of selectable directional damage effects. Partitioning of sections using barrier material allows combination of multiple effects into a single munition and reliable activation of only the desired effect(s). Barrier material can be used to partition multiple explosive/damage effect sections designed to project various damage effects, including blast waves, fragments, explosively formed projectile (EFP) liners, or shaped charge jet liners, in a specific direction relative to the warhead body. The barrier material can prevent detonation of sections other than that intended to project the desired damage effect(s). Directional projection is determined by the geometry of an explosive/damage effect section and the location of initiation. The barrier material can be used to provide structure around HE sections of complex geometry, and to manage the propagation of the detonation front, thereby enhancing the focus of damage effect(s) projection.

The barrier material may be configured in a warhead such that the HE in any unused sections is rendered undetonable by action from detonated HE section(s). This is desirable to prevent unused HE from becoming unexploded ordnance on the battlefield. HE of unused section may be rendered useless by porting reaction products from activated HE sections to initiate deflagration and consumption through burning. Also, forces from activated HE sections act to pulverize HE in unused sections into HE particles of a size less than the minimum required for detonation in a given HE. For example, the high explosive PBXN-110 requires a section width of at least 5.2 mm to sustain detonation. Pulverized particles would be on the order of 1 mm at the largest, based on calculation. Forces causing pulverization would also cause wide spread scattering of the small particles, thereby rendering detonable quantities unrecoverable.

For example, a compact warhead design is enabled with the capability to project two different damage effects: 1) a single directional EFP, and 2) 360° radial projection of metal fragments through. A warhead of this type is depicted in FIGS. 4B, 4C, and 4D.

Figure 4A:
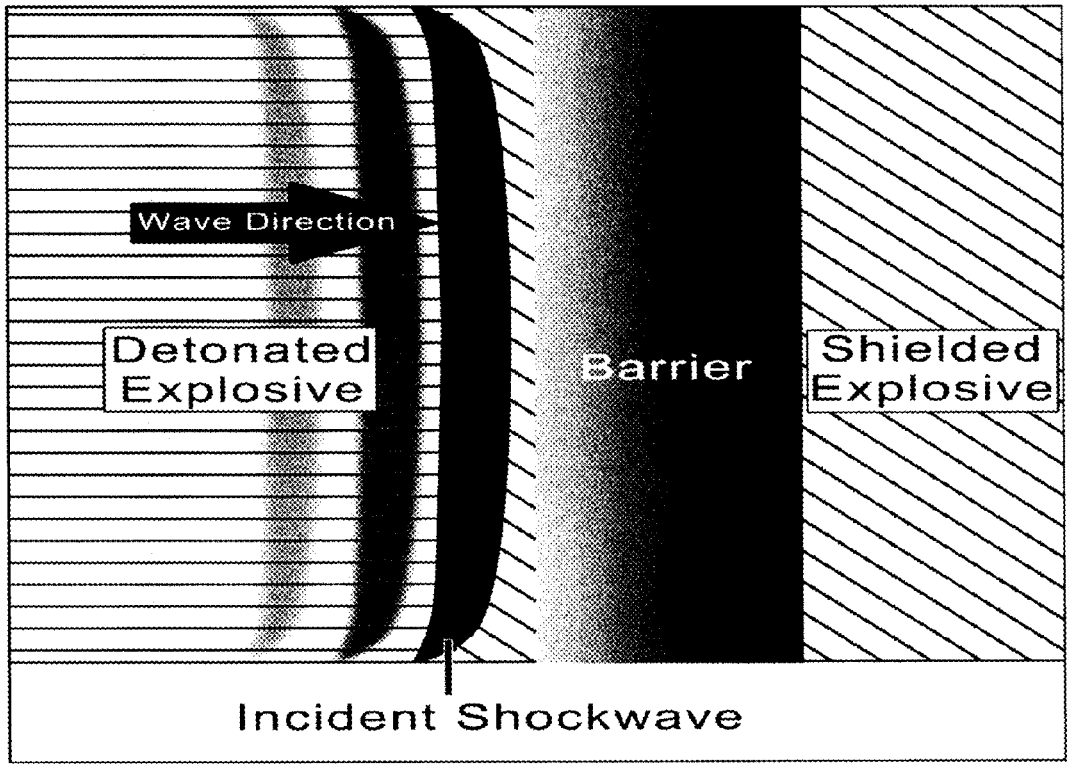
FIG. 4A is an enlarged schematic of a graded barrier of the invention in the bomb casing.
Figure 4B:
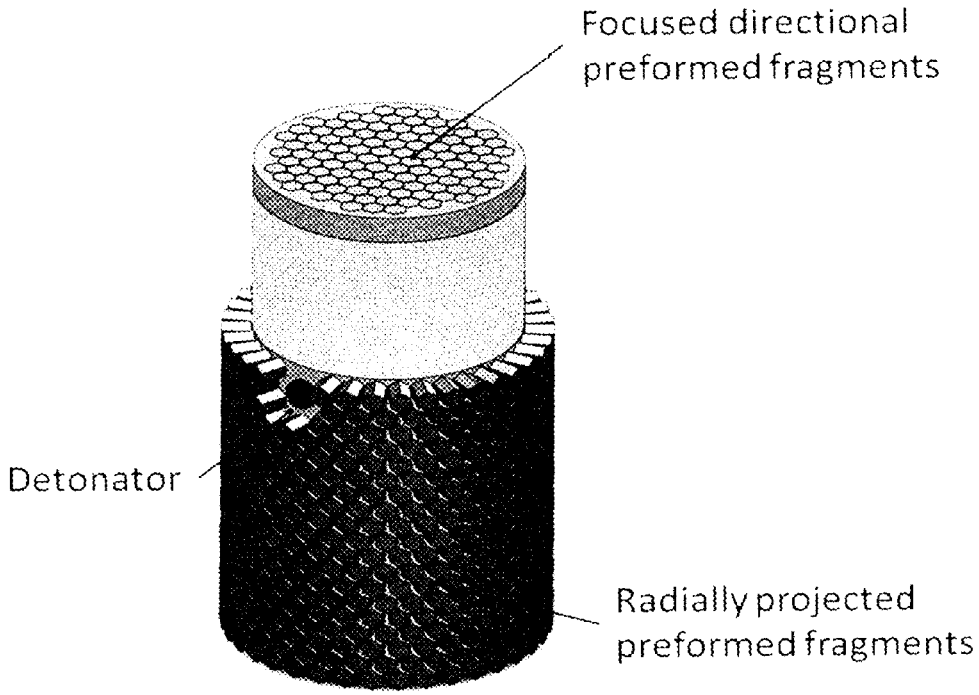
FIG. 4B is a depiction of a selectable damage effects warhead.
Figure 4C:
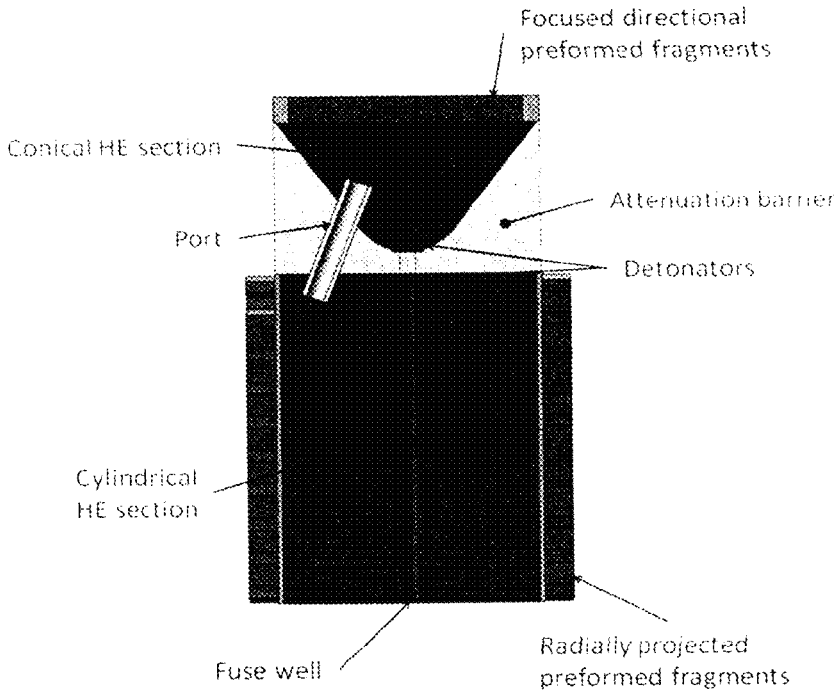
FIG. 4C is a schematic of a longitudinally partition selectable damage effects warhead.
Figure 4D:
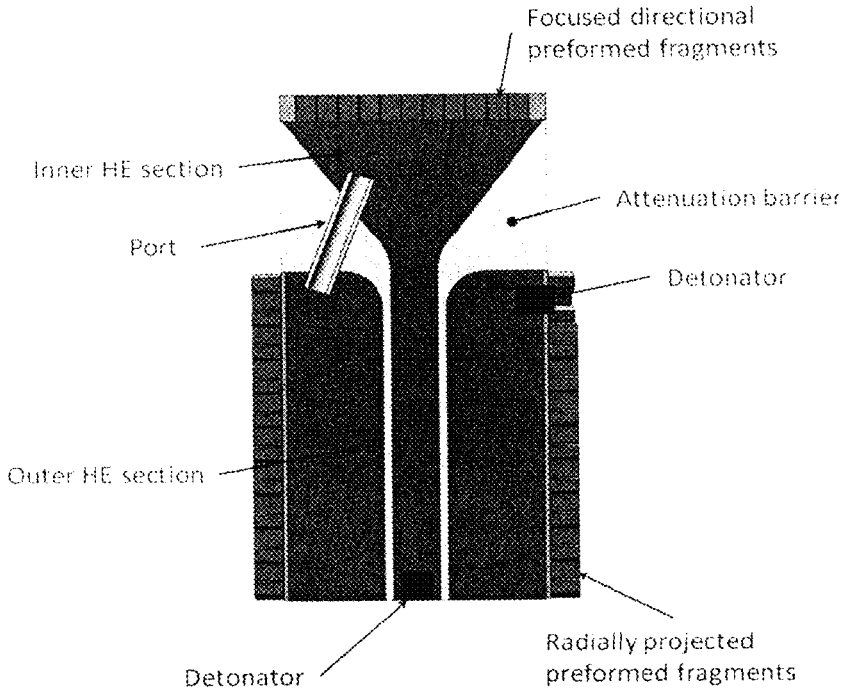
FIG. 4D is a schematic of a co-axially partitioned selectable damage effects warhead.

FIG. 4B is a depiction of an embodiment showing a selectable damage effects warhead. This illustration shows preformed fragments segregated into two groups on the cylindrical warhead body: a focused forward projection on the end, and a radial projection around the circumference. This warhead design allows damage effects to be projected in three yield modes:

1) Radial group only, producing a radial sweep of 360°

2) Forward group only, producing a focused longitudinal pattern

3) A combination of 1 and 2

In this instance the damage mechanism is explosively accelerated fragments, but other mechanisms by be substituted, e.g. shape charge jet or singular explosively formed projectile on the forward section, blast only (no fragments of projectile liners), two-phase blast using a metal loaded polymer case or liner. Yield mode is typically not dependant on physical reconfiguration of warhead prior to launch, and may be selected or changed up to the terminal flight phase. Selection of the yield mode is done by initiating one or more of the partitioned high explosive sections using one or more electronic fuzes controlled by an electronic safe-arm-fire device.

FIG. 4C is a schematic of another embodiment showing a longitudinally partition selectable damage effects warhead. This design includes two high explosive sections, with an attenuation barrier separating the sections. The barrier material also forms the structural containment of the conical high explosive section. Detonators are located on either side of the barrier.

Forward yield mode is initiated by firing only the detonator (upper) in the conical high explosive section; the detonation wave travels toward the fragments on the end. This results in complete consumption of the conical high explosive by detonation and high velocity (e.g., >4000 feet per second) focused projection of fragments located on the end. In this mode, the hollow port connecting the sections allows detonation reaction products from the forward section to pass into the cylindrical (lower) section and initiate deflagration therein. It is intended in this embodiment that a given high explosive section will be consumed (or mostly consumed) by deflagration once initiated.

Radial yield mode is initiated by firing the detonator in the cylindrical (lower) section; the detonation wave travels outward radial and downward. This results in complete (or nearly complete) consumption of the cylindrical high explosive by detonation and high velocity (e.g., >4000 feet per second) radial projection of fragments located on the outer circumference. In this mode, the hollow port connecting the sections allows detonation reaction products from the cylindrical section to pass into the conical section and initiate deflagration therein, thereby rendering it unrecoverable.

The combined yield mode is initiated by firing both detonators. This results in complete (or nearly complete) consumption of all high explosive by detonation and high velocity (e.g., >4000 feet per second) projection of fragments.

FIG. 4D is a schematic of another embodiment showing a co-axially partitioned selectable damage effects warhead. This design includes explosive sections arranged axially, with cylindrical attenuation barrier separating the two sections and acting as structural containment for the conical high explosive section.

Forward yield mode is initiated by firing only the detonator at the aft end for the inner section; the detonation wave travels toward the fragments on the end. This results in complete (or nearly complete) consumption of the inner and conical high explosive by detonation and high velocity (e.g., >4000 feet per second) focused projection of fragments located on the end. In this mode, the detonation wave is attenuated by the barrier. These attenuated pressure waves at to comminute the outer section high explosive, thereby rendering it unrecoverable. This attenuated pressure is below the threshold necessary to cause sympathetic detonation in the outer section high explosive.

Radial yield mode is initiated by firing the detonator on the outside of the cylindrical section; the detonation wave travels downward and in a geodesic path about the circumference. This results in complete (or nearly complete) consumption of the outer cylindrical high explosive by detonation and high velocity (e.g., >4000 feet per second) radial projection of fragments located on the outer circumference. The barrier acts to prevent detonation of the inner section. In this case, the hollow port allows detonation reaction products from the outer section to pass into the conical section and initiate deflagration. It is intended in this embodiment that a given high explosive section will be consumed (or mostly consumed) by deflagration once initiated.

The combined yield mode is initiated by firing both detonators. This results in complete consumption of all high explosive by detonation and high velocity (e.g., >4000 feet per second) projection of fragments.

Either or both effects may be select in the terminal phase of warhead delivery. Selectable effects packaged in a single compact warhead is desirable because of the flexibility it provides the warfighter. Damage effects selection is achieved by having an explosive section for each effect combined into a single assembly, with barrier material separating the two, and selectable fuze initiation using a electronic safe, arm, fire (ESAF) device. HE/damage effects sections may be configured in a number of ways, including barrier partitions along the length of the warhead and normal to the long axis of the warhead co-axially with a tube shaped barrier separating inner and outer HE/damage effect sections, a radial array of tubes having aligned axis.

Figure 4E:
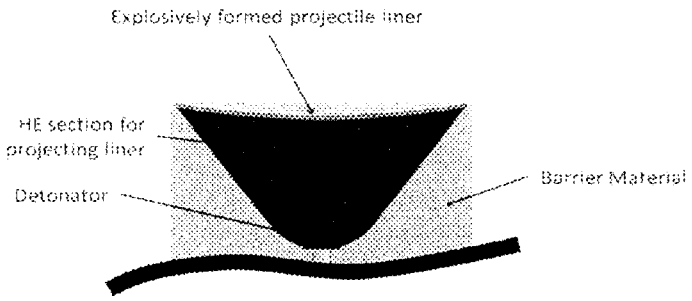
FIG. 4E is a schematic of an explosively formed projectile implemented in the forward section of a selectable damage effects warhead.

FIG. 4E is a schematic of another embodiment showing an explosively formed projectile implemented in the forward section of a selectable damage effects warhead. This forward section is representative of that seen in FIGS. 4A, 4B, and 4C, but preformed fragments have been replaced with a concaved metal liner, and the surface of the conical section high explosive has been formed to conform to the liner. The rear warhead section may retain a fragment wrap, or have other damage mechanisms.

The detonating conical section collapses the liner into a single high velocity projectile that is projected forward along the conical section axis of symmetry. The barrier containment prevents sympathetic detonation of the rear warhead section.

Figure 4F:
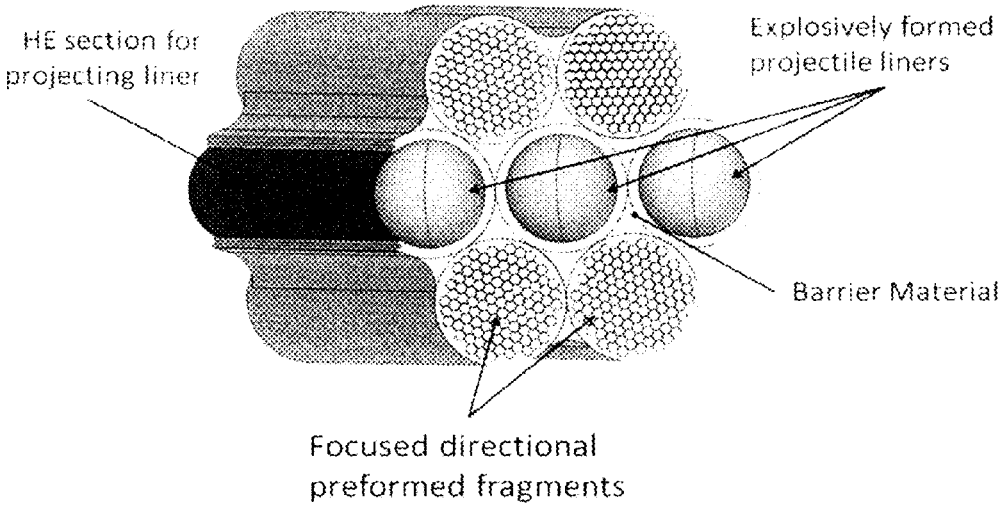
FIG. 4F is a depiction of a selectable damage effect warhead with an array aligned segments.

FIG. 4F is a depiction of another embodiment showing a selectable damage effects warhead with an array of six aligned segments. An array may have two or more sections. Each cylindrical section may have the same or different damage mechanisms as other sections. One or more sections could be detonated simultaneously, each projecting a specific damage mechanism. The array in FIG. 4F illustrates four sections having focused fragments, and three having explosively formed projectile liners. Depending on the combination and configuration of the array, selective detonation of section would determine the type and quantity of damage mechanism projected. Barrier material between the sections prevents sympathetic detonation of sections that are not intentionally detonated. High explosive in sections that are not initiated would be comminuted, thereby rendering it unrecoverable. In one embodiment of the invention, the segments of explosive material are formed with one or more ports or tubes that channel reaction products between detonating and undetonated segment to initiate deflagration in the latter.

System for Barrier Creation

A system for barrier creation generated the graded composition of the various materials by depositing these materials in a prescribed order (e.g., layer by layer). Each layer is composed of the necessary proportion of hollow sphere and/solid particles needed to achieve the blend of metal particle, microsphere, fibers, and resin. By building these layers up, and varying the blend as necessary, a panel a few centimeters thick can be created.

Build-up of material is accomplished by resin and particulate being dispersed onto a work surface from above, with relative motion between the points of dispersion and the work surface; either the work surface can move in-plane, or the points of dispersion may move over the work surface. Material is transported from the point of dispersion to the work surface by gravity, momentum, or air currents. To maintain the proper distance between the previous layer and the material dispersion points the distance between the work surface and dispersion points is incrementally increased with the completion of each layer. This process is repeated until the desired barrier thickness is achieved.

Work surface motion may be varied to create variable thickness material build up. Continuous passes in a specific areas allows creation of complex topologies on the upper surface. Overall geometric complexity may be introduced using a work surface having desired surface features and/or a net curved or faceted shape.

Particles may or may not have a coating of resin applied prior to being deposited in a build-up layer. Particles may be dispersed and flow through a duct containing aerosolized resin. Resin can accumulate on the particles passing through the duct. The degree of accumulation will be controlled by varying at least one of duct length, particle transit velocity, aerosol size, temperature, resin viscosity. Alternatively particles may be coated with resin in a green state prior to dispersion. After being deposited on the build-up surface the green resin coating may be chemically reactivated using heat, UV light, or solvents.

Key to this process is the ability to apply matrix resin to each particle in an even and consistent manner. Layers are progressively cured to a "green" state as the panel is created. This green state allows the panel to be handled and shaped as needed before a final cure, if needed.

The basic steps for barrier build up:

1) deposit layer of resin on work surface;

2) deposit desired particulate mixture and amount on resin layer;

3) cure resin to green state using heat, moisture, UV light, or elapse time as necessary;

4) apply activator/adhesion promoter as necessary to resin layer;

5) increase distance between work surface and material dispersion points to facilitate next layer;

6) deposit layer of resin on previous layer;

7) repeat the steps 2 through 6 until a desired build up is achieved;

8) remove from work surface; and 9) cure green state barrier material as needed using heat, moisture, UV light, or elapse time.

At step 2, the appropriate mixture of particles, which is at least one of hollow spheres, metal particles, energetic material particles, short fibers, is deposited to achieve a predesigned porosity/density, structural properties, or reactive response. The desired graded properties are achieved by varying the particle mix from layer to layer.

Particle dispersion may be done using any method that releases particles at a controlled rate, in the desired direction, and can be modulated on and off at will. Examples of feasible methods include vibratory feeders, centrifugal feeders, and low-pressure-high-volume spray nozzles. Bulk particle transport into these devices may be done through gravity and/or vibration. Calibration will be used to achieve the proper and reliable feed rate for various particles.

Dispersion of resin may be done using any method that releases resin at a controlled rate, in the desired direction, and can be modulated on and off at will. Resin may be aerosolized for direct application to particles using either high-pressure or low-pressure spray nozzles. Particles and aerosol may be comingled in a controlled manner during passage through a duct or manifold. Resin may be sprayed directly onto material build-up using either high-pressure or low-pressure spray nozzles.

Relative motion of work surface and material dispersion points is achieved using conventional motion-control hardware and controllers. These may include hydraulic, pneumatic, or electric drive screw actuators controlled by programmable microcontrollers.

The capability to fabricate barrier material in this manner permits a predetermined graded barrier design with optimized barrier shock transmission properties for an explosive shielding barrier to be fabricated. The resulting barriers then have intended barrier shock transmission properties. In one embodiment, the resulting barriers are of minimum thickness and parasitic mass. This fabrication procedure may also be applied in other areas, such as prototyping and production of reactive structural composites.

FIG. 5 is a schematic illustration of a barrier material generation system. In FIG. 5, the particles are dispersed by vibratory feeders, pass through a duct contained aerosolized resin, and then deposit on a build-up surface. Particle transport is through gravity and air currents. Aerosolized resin that does not adhere to particles in the duct is transported onto the build-up surface via air currents. Rate of particle dispersion is controlled through vibratory feeder vibration frequency and amplitude. Resin dispersion is controlled by spray nozzle configuration, resin viscosity as a function of temperature, and spray pressure. Even build up of material is achieved by in-plane motion of the work surface, and continually downward translation of the work surface. In this case a UV cured resin is used. Curing of deposited resin is done on a continuous base by UV sources focused on the build-up surface. After the build-up, additional heat cure of the resin is done as necessary to enhance barrier mechanical, thermal, and chemical properties.

Accordingly, in one embodiment of the invention, there is provided a method and a system for making a graded barrier. With regards to the method (with the system having the components described above to accomplish the steps recited below), the method supplies an uncured polymer to a workpiece, distributes at least one of hollow containers and solid particles into the uncured polymer as the uncured polymer is being supplied to the workpiece, and then cures the workpiece. The hollow containers and/or solid particles are provided into the uncured polymer at a varying rate which produces a spatially graded structure in which a density of the structures varies across a thickness of the workpiece. Density of the structure may be varied by changing the quantity, size, or composition of the hollow spheres, or a combination there of.

In one aspect of this embodiment, the uncured polymer deposited on the workpiece is at least one of polyurea, polyurethane, epoxy, vinyl ester. In one aspect of this embodiment, the hollow containers and solid particles distributed are at least one of hollow spheres, metal particles, energetic particles, fibers. In one aspect of this embodiment, the uncured polymer is cured by at least one of a catalyst introduced during dispersion, by heat, by moisture absorption, or by UV light. The curing can occur during a material build-up on the workpiece or subsequent to material build-up on the workpiece. The curing can occur by applying a pressure of 2 to 30 psi (above ambient) during the subsequent cure to promote material consolidation. The curing of the uncured polymer can be at room temperature conditions using a catalyst activated curing process or using UV light activation.

In one aspect of this embodiment, the uncured polymer can be dispersed using at least one of a high-pressure spraying method and a low-pressure spraying method. The uncured polymer can be applied by applying the uncured polymer directly to a work surface or a material build-up on the workpiece, or by dispersing the uncured polymer in an aerosol form into a duct or manifold.

In one aspect of this embodiment, the hollow containers and/or the solid particles can be transported through a duct to the workpiece, and the uncured polymer can be applied to the hollow containers or the solid particles during passage of the hollow containers or the solid particles in an aerosol through the duct. In one aspect of this embodiment, the hollow containers and/or the solid particles can be transported to a material build-up surface via air currents and/or gravity in the duct, and the uncured polymer can be transported to a material build-up surface via the air currents and/or gravity.

In one aspect of this embodiment, a hollow container content or a solid particle content can be varied during build-up by varying deposition of hollow containers or the solid particles from one layer to an adjacent layer. Further, the work surface can be translated in an in-plane motion during at least one of the supplying and during the distributing.

Figure 10:
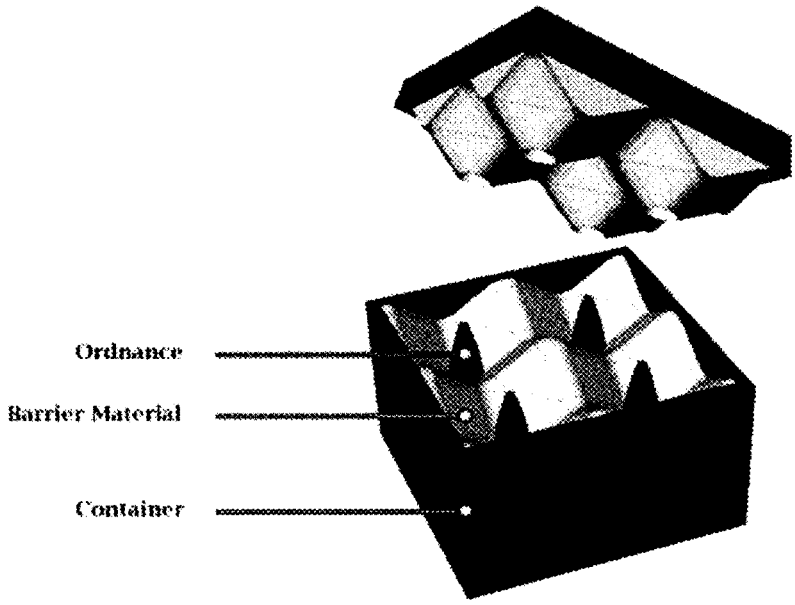
FIG. 10 is a schematic of the barrier material inside a container housing multiple ordnance.
Figure 10:
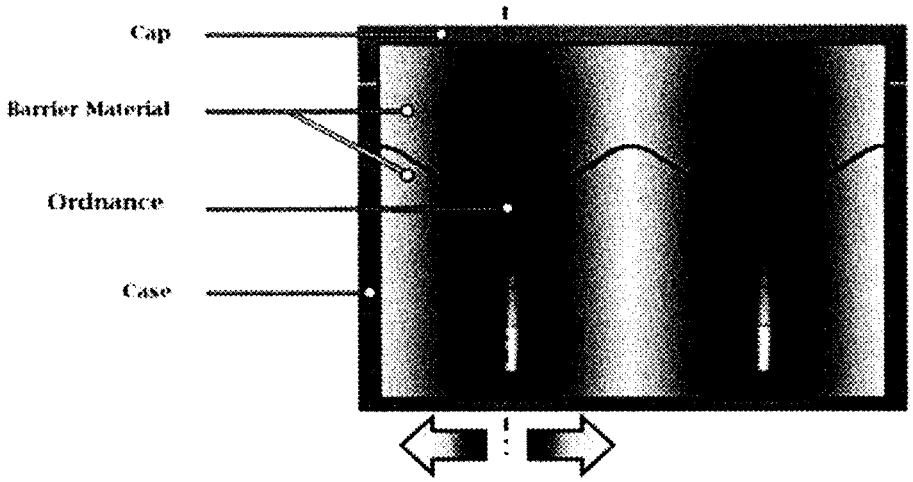

Other Application Areas:

FIG. 10 is a schematic of the barrier material inside a container housing multiple ordnance. In this application, the graded barrier material of the invention fills a container, less a void for the ordnance, missile, warhead, solid rocket motor, explosive charge, to be protected. The graded barrier material fill in this example provides protection to neighboring ordnance, missile, warhead, solid rocket motor, explosive charge, in the event of sympathetic detonation and/or reaction that generates explosive pressures exceeding 0.1 GPa. In this embodiment, the barrier density is highest at the wall forming the cavity for the protected item, with porosity content increasing due to a higher volume fraction fill of microballoons (e.g., 10 to 60%), and/or microballoon crush strength decreasing, moving away from the cavity wall. The barrier density in one embodiment reaches a minimum at the container wall, and also at the half-distances between ordnance stored in the same container. In this application, cap of the container and the case of the container include the graded barrier material of the invention. The graded barrier material is designed to minimize free space in the storage container by having re-entrant extensions in the graded barrier material of the cap and cavities in the graded barrier material of the case.

Sympathetic detonation and/reaction could be due to sources such as bullet or fragment (shrapnel) strike, heating to cookoff, severe shock loading resulting ordnance/energetic fill deformation. Neighboring ordnance may be within the same container, or outside the container. The graded barrier material functions by attenuating explosive pressure transmitted outward from the sympathetically detonated ordnance in one compartment of the container, therefore providing protection to all other nearby ordnance in the other compartments. The graded barrier material in one embodiment attenuates pressure loading on the container walls and thereby limits hazardous debris due to breakup and projection of the container material.

The barrier materials of the invention have the capability to absorb energy will also implicitly provide protection from sudden mechanical compressive loading and projectile penetration. See U.S. Pat. No. 5,862,772, the entire contents of which are incorporated herein by reference, for a discussion of non-graded syntactic materials in applications undergoing sudden mechanical compressive loading and projectile penetration. The high porosity (10 to 50%) and relatively low coefficient thermal conductivity (see Table 2 below) of the graded barrier materials of the invention can also act as thermal insulation to external heating. See U.S. Pat. No. 6,284,809, the entire contents of which are incorporated herein by reference, for a discussion of non-graded syntactic materials in applications as thermal insulation to external heating. The barrier materials of the invention can also provide appropriate mechanical support and constraint, having a stiffness modulus ranging from approximately 2.2 to 4.0 GPa, and compressive strength of at least 20 MPa.

TABLE 2

| Material | Thermal Conductivity, Watts/(meter*Kelvin) |
|---|---|
| Solid Aluminum | 235 |
| Solid nylon | 0.25 |
| Barrier material (syntactic foam) | 0.1 to 0.2 |

Figure 11:
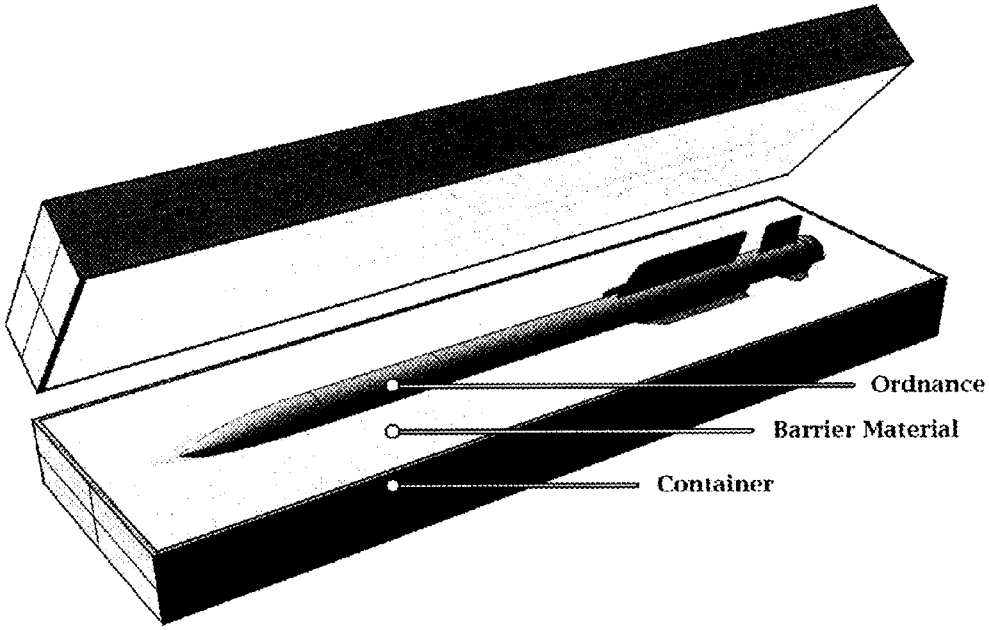
FIG. 11 is a schematic of the fitted barrier material inside a container housing a specified ordnance.

FIG. 11 is a schematic of a fitted barrier material inside a container housing a specified ordnance. In this embodiment, the cavity housing the specified ordnance has the graded barrier material form-fitted to the protected ordnance. The form fitting provides minimal pressure load concentrations. As shown in FIG. 11, the top lid of the container and the base of the container include the graded barrier material of the invention. The graded barrier material is designed to minimize free space in the storage container by having cavities in the graded barrier material for both the top lid and the base. In one embodiment, the cavities are formed by having the graded material produced according to a disposable mold having the shape of the specified ordnance to be stored in the container. After fabrication of the graded barrier material, the disposable mold is removed from the graded barrier material.

Having generally described this invention, a further understanding can be obtained by reference to certain specific examples which are provided herein for purposes of illustration only and are not intended to be limiting unless otherwise specified.

Numerous modifications and variations of the invention are possible in light of the above teachings. It is therefore to be understood that within the scope of the appended claims, the invention may be practiced otherwise than as specifically described herein.

The invention claimed is:

1. An explosive device comprising:

an exterior housing;

partitioned segments inside the housing, at least one of which is filled with an explosive material; and a partition wall separating the segments, wherein the partition wall comprises, a spatially graded structure in which a density of the structure varies across a thickness thereof, said structure including a polymer having hollow containers dispersed in the polymer to vary said density of said graded structure, and a selective fuzing scheme wherein the segments filled with the explosive material are selectively initiated.

2. The device of claim 1, wherein the segments of explosive material comprise separate detonation initiators.

3. The device of claim 1, wherein the segments of explosive material comprise one or more ports or tubes that channel reaction products between detonating and undetonated segment to initiate deflagration in the latter.

4. The device of claim 1, further comprising one of more hollow channels;

said hollow channels extending into the segments of explosive material; and passing through the partition wall.

5. The device of claim 4, wherein the hollow channels comprise tubes.

6. The device of claim 5, wherein the hollow channels are filled with gas.

7. The device of claim 6, wherein the tubes comprise caps to contain the gas.

8. The device of claim 6, wherein the gas comprises at least one of air, helium, oxygen, or xenon.

9. The device of claim 6, wherein the gas has a fill pressure ranging from 0.3 kPa to 7.0 MPa.

10. The device of claim 6, wherein the tube comprises at least one of polycarbonate, poly(methyl methacrylate), ceramic, steel, or fiber composite.

11. The device of claim 1, wherein the segments are selectively initiated to produce a specific damage effect.

12. The device of claim 11, wherein one or more of the partitioned segments containing explosive are combined into preformed fragments.

13. The device of claim 11, wherein one or more of the partitioned segments containing explosive are combined into a metal explosively formed projectile liner.

14. The device of claim 11, wherein one or more of the partitioned segments containing explosive are combined into a liner that produces a two-phase blast flow.

15. The barrier of claim 1, wherein the spatially graded structure comprises a barrier density ratio from donor side to acceptor side of at least 2 to 1, and as high 10 to 1.

16. The barrier of claim 1, wherein the spatially graded structure comprises at least one of a stepwise variation in said density or a continuous variation in said density.

17. The barrier of claim 1, wherein the spatially graded structure is configured to attenuate pressures shock waves of magnitudes >0.1 GPa.

18. The barrier of claim 1, wherein the spatially graded structure is configured to shield reactive materials by absorbing sufficient energy of an impinging shock wave on one side of the graded structure such that the reactive material on another side does not react.

19. The barrier of claim 1, wherein the hollow containers comprise hollow spheres.

20. The barrier of claim 1, wherein the hollow containers comprise at least one of glass, ceramic, or carbon shells.

21. The barrier of claim 1, wherein the hollow containers comprise hollow spheres having an outside diameter of 10 to 500 μm.

22. The barrier of claim 1, wherein the graded structure has an interior porosity of 10% to 35%.

23. The barrier of claim 1, wherein the graded structure further comprises solid particles.

24. The barrier of claim 23, wherein the solid particles comprise metal particles.

25. The barrier of claim 24, wherein the metal particles comprise at least one of aluminum, iron, magnesium, titanium, or a combination thereof.

26. The barrier of claim 24, wherein the metal particles comprise at least one of flakes, rods, tubes, balls, or spheres.

27. The barrier of claim 24, wherein the metal particles have a size of 50 nm to 1000 nm.

28. The barrier of claim 24, wherein the metal particles have a size of 1 μm to 500 μm.

29. The barrier of claim 23, wherein the solid particles are non-metallic fibers.

30. The barrier of claim 29, wherein the fibers comprise at least one of glass, carbon, basalt, aramid, or a combination thereof.

31. The barrier of claim 29, wherein the fibers have a length of 10 nm to 1 cm.

32. The barrier of claim 23, wherein the solid particles comprise a reactive material configured to react during a detonation of an explosive against the graded structure.

33. The barrier of claim 32, wherein the reactive material comprises an explosive crystal.

34. The barrier of claim 33, wherein the explosive crystal comprises at least one of Tetranitro-tetraazacyclooctane (HMX), Cyclotrimethylenetrinitramine (RDX), Triaminotrinitrobenzene (TATB), and Pentaerythritol-tetranitrate (PETN).

35. The barrier of claim 32, wherein the reactive material comprises a pyrotechnic composition.

36. The barrier of claim 32, wherein the reactive material comprises a bi-metallic reactive.

37. The barrier of claim 36, wherein the bi-metallic reactive comprises at least one of Ni and Al and Al and Li.

38. The barrier of claim 1, wherein the polymer comprises at least one of epoxies, urethanes, polyureas, and polyamides.

39. The barrier of claim 1, wherein the hollow containers have a collapse strength of 250 to 28000 psi and are included in the graded structure at a content of greater than 15%, and up to 75%.

40. The barrier of claim 1, wherein the graded structure is configured to transmit pressures insufficient to cause detonation of the explosive material in contact with one side of the graded structure.

41. The barrier of claim 40, wherein detonation is prevented in the explosive material.

42. The barrier of claim 40, wherein deflagration is prevented in the explosive material.

43. The barrier of claim 40, wherein the explosive material is a solid propellant.

44. The barrier of claim 43, wherein detonation is prevented in the solid propellant.

45. The barrier of claim 43, wherein deflagration is prevented in the solid propellant.

46. The barrier of claim 1, wherein the graded structure has a stiffness of >3.6 G Pa.

47. The barrier of claim 1, wherein the graded structure comprises a structure having a failure strain of >100%.

48. The barrier of claim 1, wherein the graded structure has a tensile strength of 3.5 to 70 MPa.

49. The barrier of claim 1, wherein the graded structure comprises a porosity of fill no greater than 50%.

50. The barrier of claim 1, wherein said density of the structure varies across said thickness comprises a density from 0.1 to 10.0 gram/cm$^3$.

51. The barrier of claim 1, wherein said density of the structure varies across said thickness comprises a density from 0.5 and 5.0 gram/cm$^3$.

52. The barrier of claim 1, wherein said density of the structure varies across said thickness comprises a density from 0.6 and 2.0 gram/cm$^3$.

53. The barrier of claim 1, wherein said density of the structure varies across said thickness comprises a density from 0.6 and 2.5 gram/cm$^3$.

54. The barrier of claim 1, wherein said density of the structure varies across said thickness comprises a density from 0.6 to 1.6 gram/cm$^3$.

55. The barrier of claim 1, wherein said density of the structure varies across said thickness comprises a density from 0.5 to 1.2 gram/cm$^3$.

* * * * *